United States Patent [19]

Rowland

[11] 4,456,296

[45] Jun. 26, 1984

[54] STACKABLE ARMCHAIR

[76] Inventor: David L. Rowland, 8 E. 62nd St., New York, N.Y. 10021

[21] Appl. No.: 272,692

[22] Filed: Jun. 11, 1981

[51] Int. Cl.[3] ..... A47C 15/00

[52] U.S. Cl. ..... 297/239; 297/445; 297/452

[58] Field of Search ..... D6/57, 70, 73, 76, 77; 297/445, 452, 239, 232; 248/188.91

[56] References Cited

U.S. PATENT DOCUMENTS

| | | | |
|---|---|---|---|
| 1,993,601 | 3/1935 | Goldberg | 297/239 |
| 2,789,631 | 4/1957 | Vosbikian et al. | 248/188.91 X |
| 2,952,306 | 9/1960 | Odler | 248/188.91 X |
| 3,446,530 | 5/1969 | Rowland | 297/239 |
| 4,035,019 | 7/1977 | Gabourie | 297/239 |

FOREIGN PATENT DOCUMENTS

| | | | |
|---|---|---|---|
| 2269893 | 12/1975 | France | 297/239 |
| 524397 | 8/1940 | United Kingdom | 297/239 |
| 754209 | 8/1956 | United Kingdom | 297/239 |

*Primary Examiner*—James T. McCall
*Attorney, Agent, or Firm*—Owen, Wickersham & Erickson

[57] ABSTRACT

A stacking armchair and a chair frame therefor. A horizontal frame member has an U-shaped, horizontal portion and a pair of downwardly and outwardly turned vertical front portions. The horizontal portion comprises a lateral rear portion and horizontal side portions that lie generally parallel to each other, but diverge somewhat from rear to front. Two frame juncture members are secured to the frame side portions adjacent the rear lateral portion. Each of a pair of rear legs with integral back-support portions is secured to a frame juncture member, so that they are spaced apart from each other farther than are the side rails. They provide nearly parallel back-support portions that diverge slightly from each other. To these, along mating sloping faces are secured arm and front leg members providing arms parallel to and outboard of said side rails and also providing the chair's vertical front legs. The front portions of the horizontal frame member are secured to upper portions of the front legs. A seat (preferably non-rigid and resilient) bridges and is secured to the frame side portions and urges them toward a truly parallel relationship, and a similar back bridges and is secured to the back-support portions and, urges them toward a truly parallel relationship.

27 Claims, 25 Drawing Figures

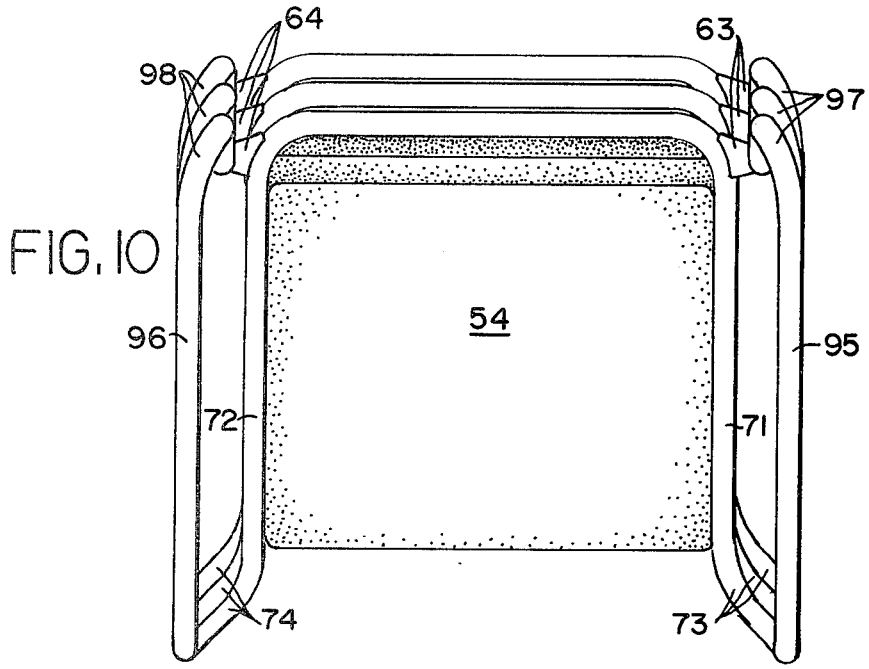
FIG. 10
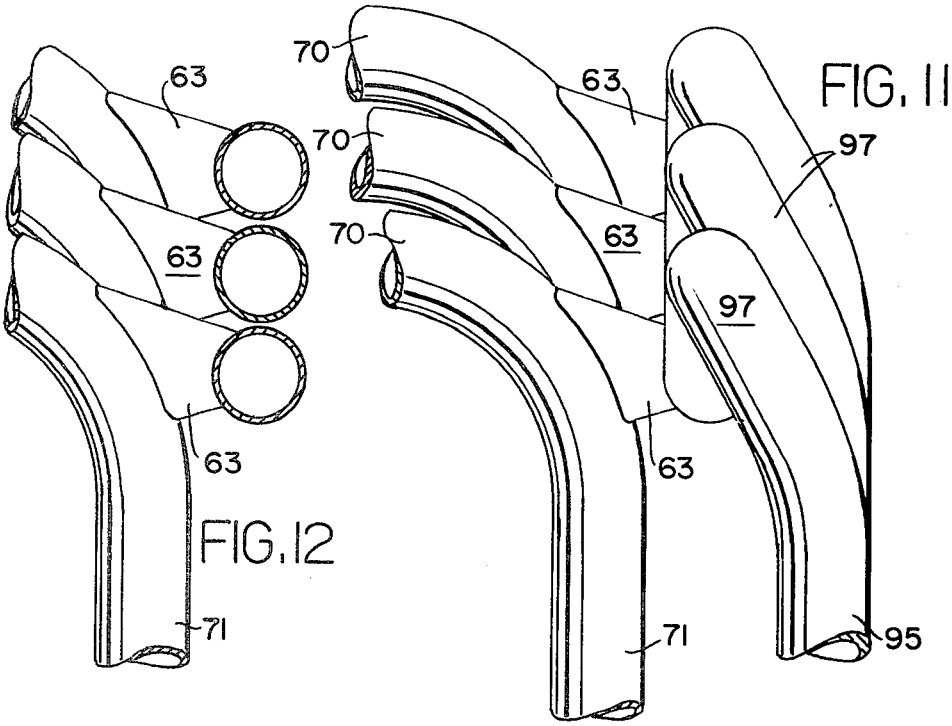
FIG. 11
FIG. 12

FIG. 21
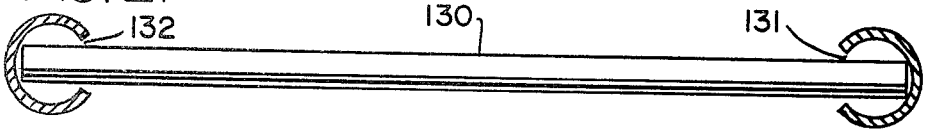
FIG. 22
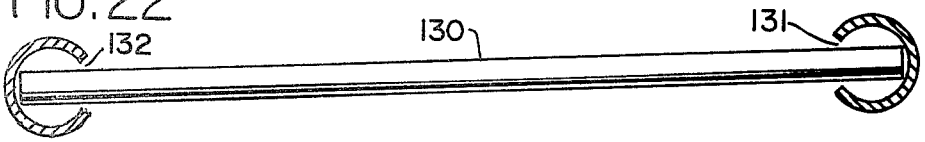
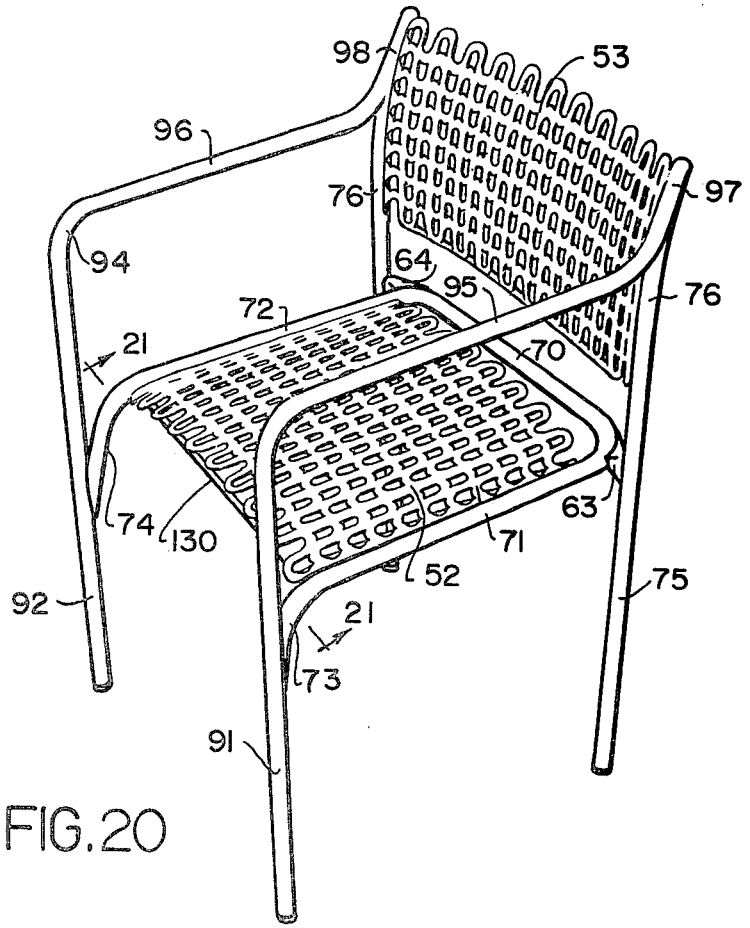
FIG. 20

STACKABLE ARMCHAIR

BACKGROUND OF THE INVENTION

This invention relates to an improved armchair, to an improved compactly stacking armchair, and to a frame therefore.

The armchair of this invention preferably utilizes much of the structure of my invention shown and claimed in U.S. patent application Ser. No. 46,836, filed June 8, 1979, now U.S. Pat. No. 4,304,436 and also some of the structure shown in U.S. patent application Ser. No. 157,682 filed June 9, 1980, now U.S. Pat. No. 4,336,980.

As stated in those earlier applications, stackable chairs have heretofore usually been so designed that when nested in a stack there was considerable vertical space between them, often two or three inches. As a result, only a few chairs could be put into one stack; moreover, stacking them and removing them from the stack was difficult. Compact stacking has been rare, although it has been achieved with special structures. Compact stacking of armchairs has been even rarer.

Another difficulty with many stackable chairs was that in each the frame was made up of several frame members. If these frame members were strong, they were usually relatively heavy; if they were light in weight, they were usually not sufficiently strong. Such chairs usually required a front horizontal stretcher to provide sideways stability, especially when the leg members were thin. This sometimes was uncomfortable in that the back of the sitter's legs would hit this front horizontal stretcher bar.

Heretofore, stackable chairs were especially heavy because they required such extra frame members. Stackable chairs made of steel tubing heretofore typically required either a stiff frame member or stiff shelf portion across the top of the back and another stiff frame member or stiff shelf portion across the front of the seat. As an alternative, the seat and the back had to be so rigid that they would provide the needed strength. The more rigid the seat or back was, the less comfortable it was.

Another problem with stackable chairs was their rigidity. This problem relates even to the chair disclosed in my earlier issued U.S. Pat. No. 3,845,986, which is otherwise excellent. In other chairs, too, rigid members or portions at the top or across the seat or across the legs added to the discomfort of the user. In some cases, a top bar across the back is convenient to the people who move the chairs from one place to another, but it does detract from the comfort if the sitter's back can come against it. Such rigidity was thought necessary to strength and stability, but it has tended to prevent a chair from being able to level itself on uneven floors. This has had particular disadvantages when such chairs were used in outdoor cafes, where stackability is very desirable, but where the inability of the legs to level to uneven surfaces made the chairs awkward, uncomfortable, or annoying to the users. Conventional rigid frame chairs have tended to rock on such uneven surfaces and, therefore, to bring the chairs into the minds of the users far too often.

Heretofore, stackable chairs, when stacked, have usually resulted in the frame of one coming against the frame of the other. Often this had done so in a manner such as to scratch the frames or to scrape off their finish. If they were spaced apart vertically so as to protect the finish so much space was left that the stack could not be compact, as remarked earlier.

Among the objects of the present invention are those of solving the problems enumerated above. Thus, it is an object of this invention to provide a comfortable, compactly stackable armchair; to provide a stackable armchair that does not need to incorporate a front, horizontal, rigid stretcher, especially one between the legs; an armchair that is not completely rigid so that it can flex sufficiently to accommmodate itself to an uneven floor; to provide a stackable armchair which can be relatively light in weight; and to provide a stackable armchair in which the frame members of each are protected from scratching and from rubbing together.

Other objects and advantages of the invention will appear from the following description.

SUMMARY OF THE INVENTION

The invention comprises a compactly stackable armchair and a frame for such an armchair. The frame includes a seat frame element comprising a U-shaped horizontal portion turned down and outwardly at the front to provide a pair of generally vertical front portions. More specifically, the U-shaped portion has a rear, horizontal cross or lateral portion, joined at each end by a corner to a horizontal side portion, each of which is respectively joined by a corner to a front generally vertical portion. The front portions diverge from each other, and the side portions are generally parallel to each other but diverge slightly from rear to front.

The frame also includes a pair of rear legs, two separate members, each with a back-support portion in line with the rear leg but preferably curving slightly rearwardly at the upper end. The back-support portions are generally parallel to each other, but they preferably diverge slightly as one moves upwardly.

These frame members are secured together by a pair of frame juncture and spacing members. Preferably, each of these is shaped as a generally triangular-looking cup with a horizontal top and a pair of vertical depending sides. The top has a pair of horizontal edges and each vertical side has a pair of vertical edges at each end. A wider horizontal edge and two of the vertical edges are preferably welded to the sides of the main frame element adjacent to the corners by which the cross member merges into the side members, thereby providing sidewise spacing. The other horizontal edge and two vertical edges are each preferably welded to a rear leg.

The frame is completed by a pair of arm and front leg frame members, one at each side, with a rear portion extending down from the upper ends of the back-support members, a generally horizontal front portion extending parallel to and to the outside of the side portion of the U-shaped frame for substantially the rear-to-front extent of the armchair frame, and then a generally vertical front leg portion that provides the chair's front legs and to which is secured the forward, downwardly and outwardly turned portions of the U-shaped frame. To enable rigid attachement to the rear-leg frame members, the back-support members are provided with an oblique edge that lies along a nearly vertical plane, and the rear portion of the arm member has a matching surface and extends somewhat forwardly as well as primarily vertically. The inner edges of the arms are outboard of the outer surface of the rear legs, to enable compact stacking, but they are generally parallel to each other, though they may diverge slightly. At the front, each of the U-frame's downturned members are provided with a tapered junction portion that is secured to a front leg.

A seat, preferably non-rigid and resilient, bridges and is secured to the two side portions of the frame and urges them toward a truly parallel relationship, while, similarly, a back, also preferably non-rigid and resilient, bridges and is secured to the two back-support portions and urges them toward a truly parallel relationship. These seat and back portions may be made from the materials shown in U.S. Pat. Nos. 3,720,568 and 3,843,477. When that material is used (usually sold under the name SOFLEX®) then an especially comfortable and resilent seat is obtained. The SOFLEX® seat or back may be covered or encased in additional fabric.

To prevent the frame members from becoming scratched during stacking, each frame side portion may be provided with two plastic members like those shown in Ser. No. 157,682, secured to or projecting from a lower surface of the side portions, one preferably near the front and the other preferably near the rear. One of these faces inwardly and the other faces outwardly, to provide a kind of locking engagement, effective to space the successive chairs slightly apart so that they rest on these non-scratching plastic members but are still compactly stacked.

The frame elements may be metal or bentwood, for example, and, if metal, all may be made of the same tubular stock, if desired. When tubular stock is used, a bottom glide may be inserted into the tube at the bottom of each leg and may comprise a plastic member with an outer portion substantially the same diameter as that of the leg.

If somewhat more security against inward collapsing of the seat portion is desired, this can be achieved without losing the flexibility of the frame by a metal rod or tube bridging between the forward parts of the side portions but not rigidly connected to them. The rod fits into a respective opening through a wall of a side portion and may bear against the wall opposite to the opening, but the rod is not welded or secured to the side portions, so that the rod is still free to move somewhat in the opening, thereby enabling the frame to flex. For that purpose, the opening is made somewhat oversize.

Other features will appear from the following description.

BRIEF DESCRIPTION OF THE DRAWINGS

In the drawings:

FIG. 10 is a top plan view of three armchairs like those of FIG. 1, except for the seat, in a stack, with the backs omitted in order to show more clearly the frame-connecting-and-spacing members of FIGS. 5–9.

FIG. 11 is an enlarged fragmentary plan view of one rear corner of the same three armchairs of FIG. 10, showing here the arm coming out from the top of the rear leg.

FIG. 12 is a similar view with the arm omitted and the rear leg shown in section.

FIG. 20 is a perspective view of a modified form of armchair of this invention in which a free-floating rod or tube is placed in a non-rigid manner across the forward portions of two side portions.

FIG. 21 is a view in section along the line 21—21 in FIG. 20.

FIG. 22 is a view similar to FIG. 21 illustrating a flexing position that can be obtained with this structure.

DESCRIPTION OF SOME PREFERRED EMBODIMENTS

Figure 1:
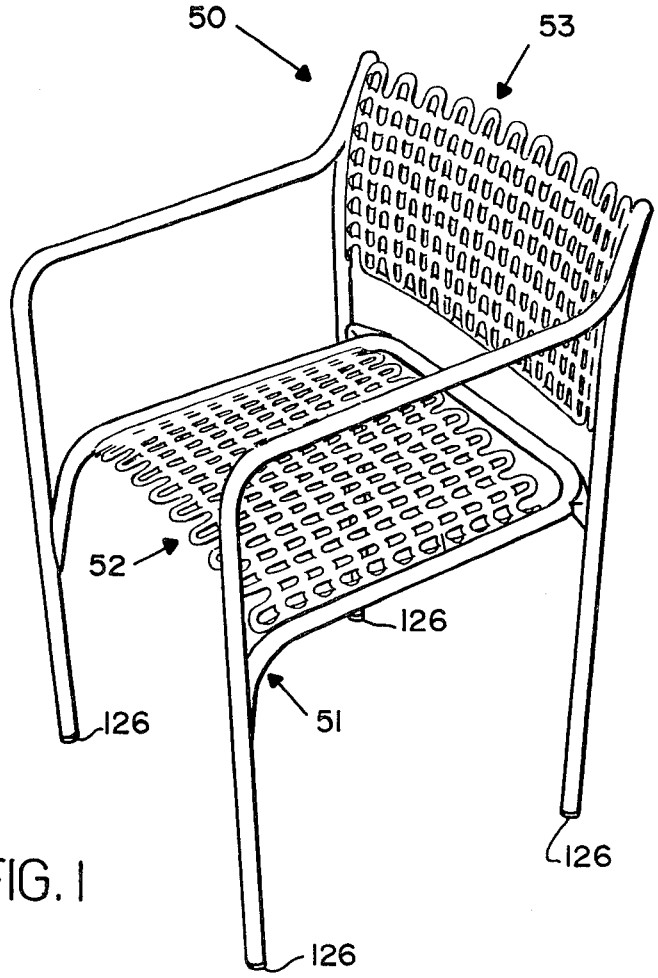
FIG. 1 is a view in perspective of an armchair embodying the principles of the invention and incorporating an armchair frame embodying the principles of the invention.
Figure 4:
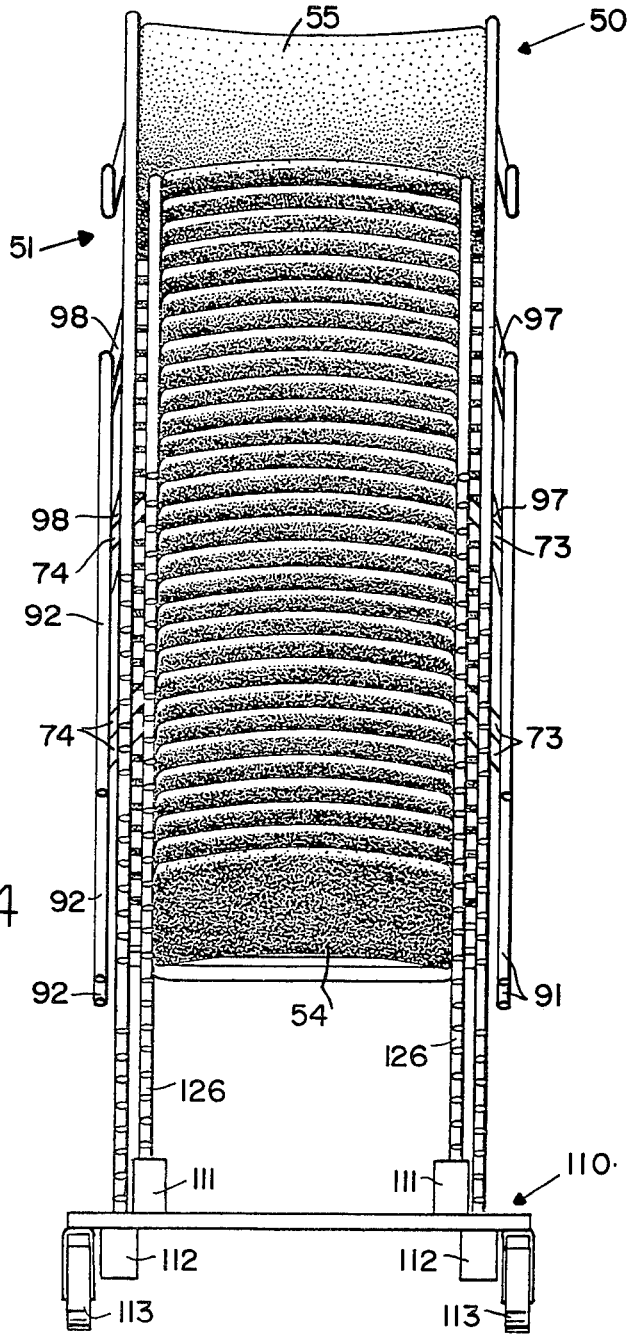
FIG. 4 is a view in front elevation of the stack of FIG. 3.
Figure 6:
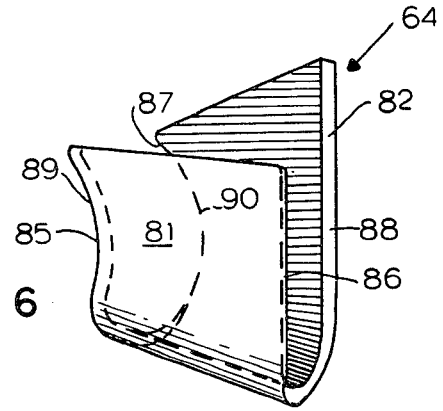
FIG. 6 is a view in rear elevation of the frame-connecting-and-spacing member of FIG. 5.
Figure 7:
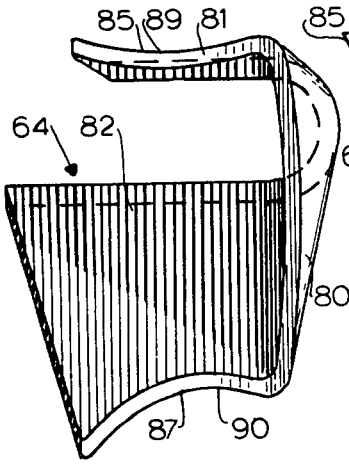
FIG. 7 is a right side elevation thereof.
Figure 5:
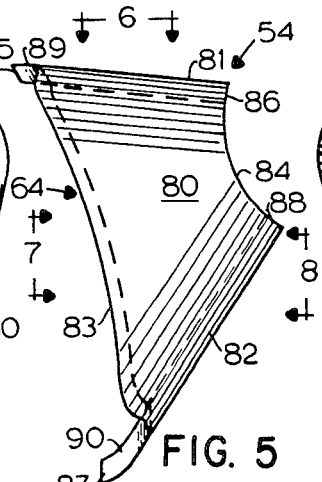
FIG. 5 is a top view of a left-hand, frame-connecting-and-spacing member employed in the armchair of FIG. 1.
Figure 8:
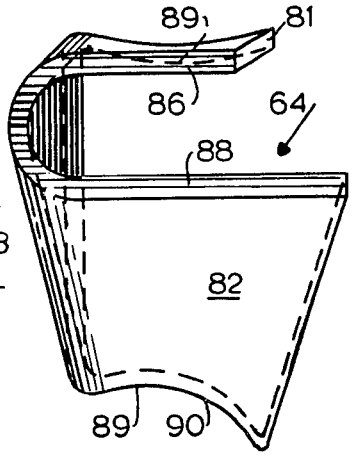
FIG. 8 is a left side elevation thereof.
Figure 9:
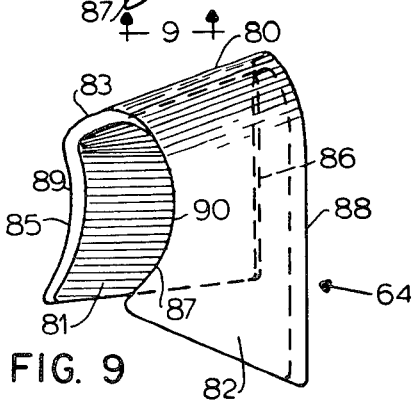
FIG. 9 is a front view thereof.
Figure 14:
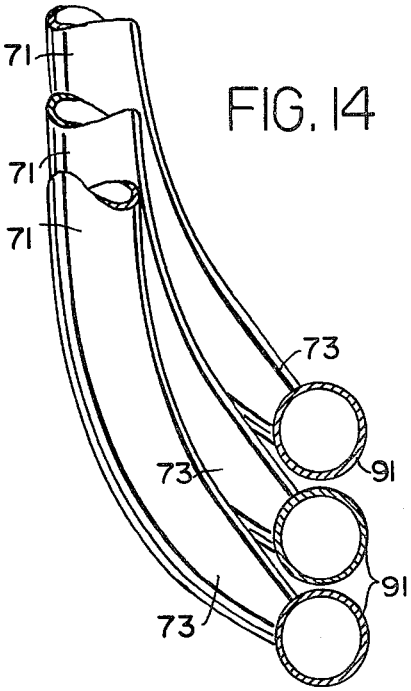
FIG. 14 is a view like FIG. 13 but with the arm cut off and the front leg shown in section, at its juncture, with the front portion of the U-shaped frame.
Figure 13:
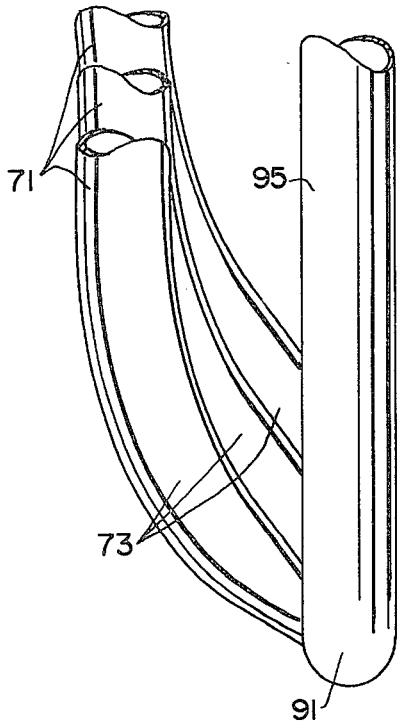
FIG. 13 is an enlarged fragmentary top plan view of a front corner portion of the same three chairs, showing the arm and the juncture therewith of the downturned and outturned front portions of the U-shaped frame which blend into and are brazed to the front leg.
Figure 15:
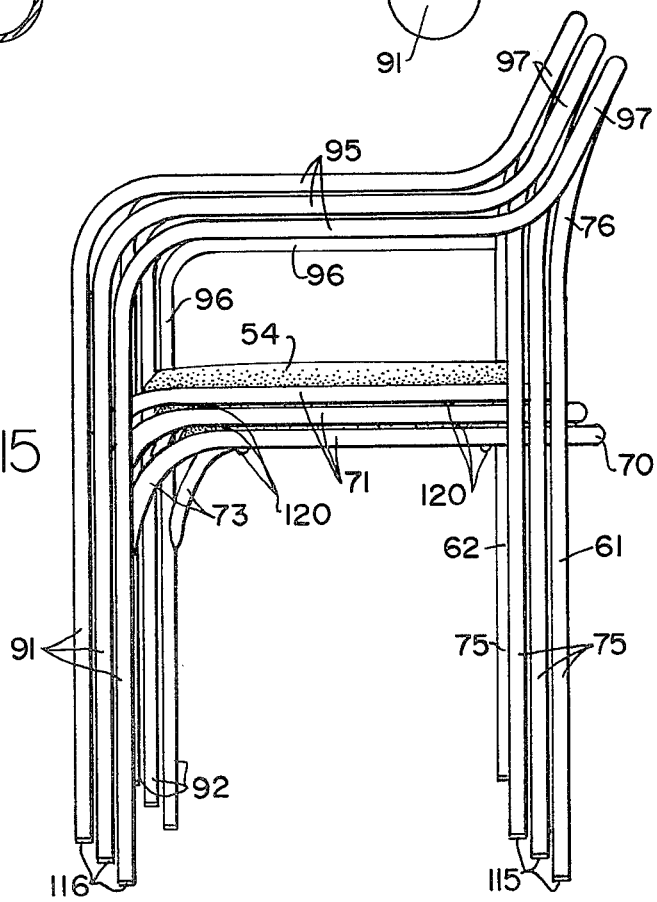
FIG. 15 is a side view in perspective of three stacked armchairs of the invention.

The armchair in general (FIG. 1):

FIG. 1 shows in perspective a stacking armchair 50 embodying the principles of the invention. The armchair 50 has a frame assembly 51, a seat 52, and a back 53. The seat and back assemblies 52, 53 as has been said earlier, preferably employ the structure shown in my U.S. Pat. Nos. 3,720,568 and 3,843,477. This is preferred though not essential because that structure is excellent for seats and backs; as shown in FIGS. 4, 10, and 15 the seats and backs may be covered or encased, if desired, to give a seat assembly 54 and a similar back assembly 55.

Figure 2:
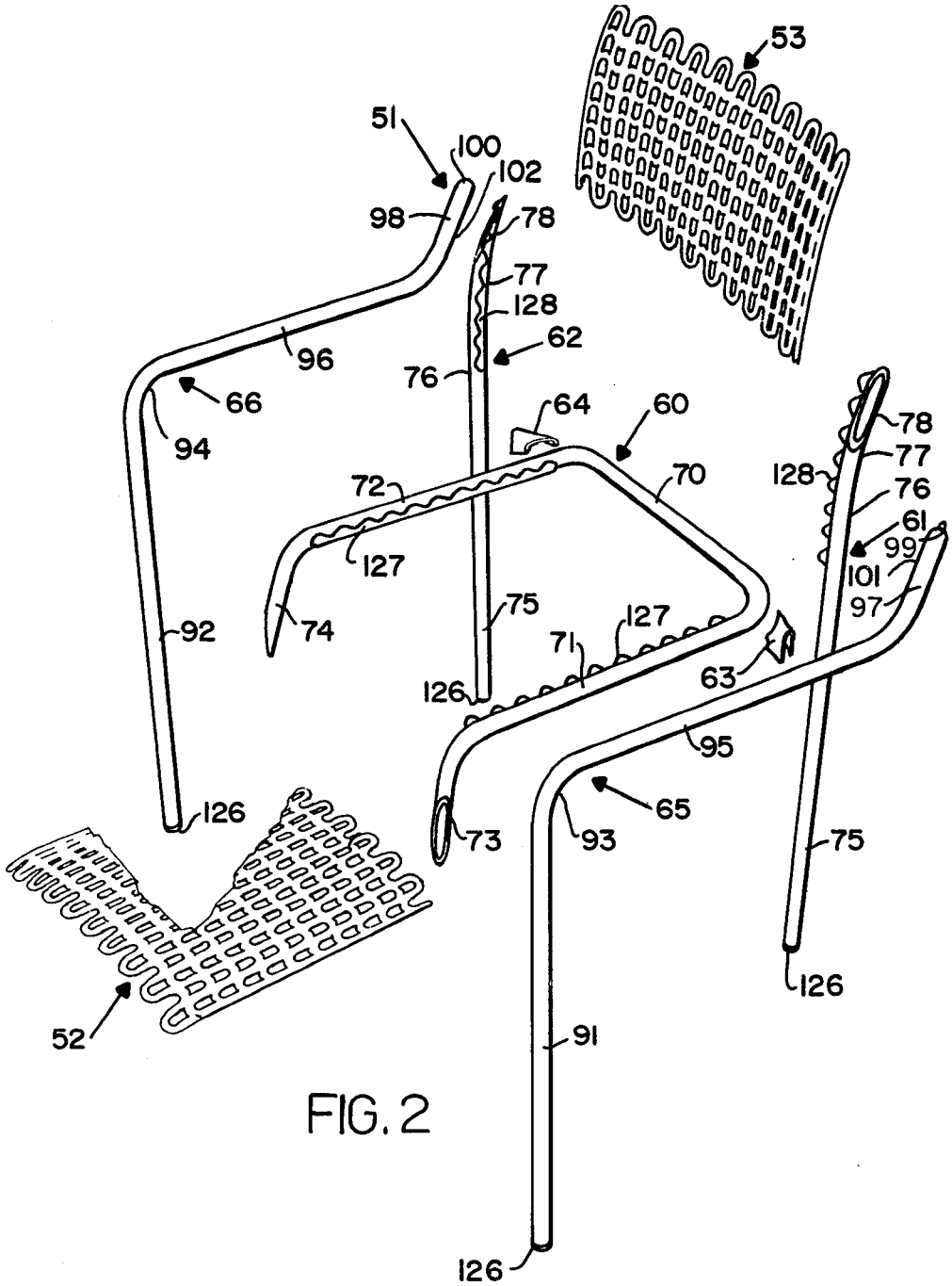
FIG. 2 is an exploded view of the armchair of FIG. 1 showing the frame members, the seat, and the back; the seat member has been broken off to conserve space.

The frame assembly 51 (FIG. 2)

FIG. 2 is an exploded view of the frame assembly 51 and shows all the elements of that frame. The frame assembly 51 includes as principal ingredients a seat frame element 60, two rear leg and back support frame elements 61 and 62, two frame-connecting-and-spacing members 63 and 64, and two arm and front leg frame members 65 and 66.

The seat frame member 60 has a horizontal U-shaped portion with depending front portions. Thus, it has a rear horizontal cross, lateral, or stretcher member 70 joined to side rail portions 71 and 72 by rounded corners, and these side members 71 and 72 are joined by rounded corners at their forward end to two downwardly and outwardly turned portions 73 and 74. Thus, the entire seat frame member 60 may be made from a single piece of metal tubing bent to shape.

The two rear leg and back support frame elements 61 and 62 are preferably identical, each of them having a rear leg portion 75 an upper back-supporting portion 76, each preferably having a rearwardly inclined portion 77 which terminates at its upper end in an oblique edge 78, which is planar along a steeply sloping, nearly vertical plane.

A preferred form of the frame-connecting and spacing members 63 and 64 is illustrated in enlarged form in FIGS. 5 to 9. The members 63 and 64 are symmetric to each other and, when attached, are cup-like in shape and, from above appear somewhat trapezoidal. Thus, it has a generally trapezoidal, essentially flat, upper horizontal wall portion 80 from which depend vertical side walls 81 and 82, via downwardly curving corners. At the opposite ends of the upper wall 80 are a long, mostly curved horizontal edge 83 and a shorter semicircular horizontal edge 84. The edge 84 has a radius to fit its rear leg frame member 61 or 62 and is welded thereto. The edge 83 is curved to match the curve joining the stretcher 70 to the side rail 71 or 72 where it abuts it. The vertical side walls 81, 82 have vertical edges 85, 86, 87, and 88. The edge 83 and the edges 85 and 87 form a continuous edge which is welded by any suitable welding technique to the seat frame member 60. The location is important, and the connecting members 63 and 64 are continuously shaped to fit the seat frame member 60 at an exact spot, near and along part of the corners and preferably including a portion thereof, but also partly along the rear end of the side rail members 71 and 72 so that the members 63 and 64 will act to space the rear leg frame members 61 and 62 out laterally from the seat frame 60. The edges 86 and 88 may be straight, to abut the rear leg frame member 61 or 62, but the edges 85 and 87 are curved to match the contour of the side rail 71 or 72 and other portions of the seat frame 60 they are to abut, as shown at 89 and 90. The securing to the rear leg frame members 61 and 62 is done along the edges 84, 86, and 88, which also lie as a continuous edge, and again, welding is used.

The result is that the members 63 and 64 and the welding provide rigid connections between the shaped frame members 60, 61 and 62. Thus, the two connecting and spacing members 63 and 64 rigidly connect each of the rear leg frame members 61 and 62 to the seat frame member 60 at a point near the back thereof and spaces the rear legs 75 out laterally sufficiently so that the chair 50 can stack compactly. The rear legs 75 are therefore farther apart than the side rails 71 and 72; for example, the inside edges of the rear legs 75 may lie about ⅜" outside of the outside edge of the side rails 71 and 72. To assure maximum strength of these important connections, all of the joining edges 83, 84, 85, 86, 87, and 88 are preferably welded throughout their full length to the frame tubes 60, 61, 62. The welding is all done from below and inside the box-like configuration, so that the whole gives a clean appearance, eliminating the need for finishing off the welds. The members 63 and 64 are so shaped and located that they do not interfere with the compact stacking and do not engage their corresponding parts on other chairs when the chairs are stacked.

Since the stretcher 70 is the only member connecting together the two sides of the frame 51, there can be considerably flexibility in the portions of the frame 51 that are remote from the stretcher 70 and the connecting members 63 and 64, even though the frame members 60, 61, and 62 are preferably made from tubular steel. For the frame 51 to be rigid there would have to be some additional members rigidly securing the front legs to each other or securing the side members 71 and 72 rigidly together. While such rigidity might be feasible, it is not considered desirable.

The side portions 71 and 72 preferably diverge from each other to rear and front so that the distance between the front portions of the side rails 71 and 72 is preferably at least 5% greater than the distance they would be if they were truly parallel and to which they are usually held by the seat 52 or 54. Similarly, the upper ends 78 of the back portions 76 preferably diverge from the connection members 63 and 64 so that the distance between them is preferably at least 5% greater than the distance to which they are brought by the back 53 or 55 in the preferable constructions. This enables spreading and, as it will be seen later, the same absence from rigididy has advantages in enabling the user to sit comfortably while the chair legs are resting on an uneven surface.

The arm and front leg frame members 65 and 66 (FIG. 2)

The frame 51 is completed by securing the arm and front leg frame members 65 and 66 to the frame members 60, 61, and 62, as by brazing or welding for metal frames.

The two frame members 65 and 66 are symmetrical, each having a front leg portion 91, 92 which is vertical and is joined by a respective rounded corner 93, 94 to a horizontal arm portion 95, 96. The rear end of each arm portion 95, 96 is integral to a steeply sloping, upwardly and inwardly extending portion 97, 98 that terminates in a hemispherical end 99, 100, and an inboard length 101, 102 mates exactly with and is secured (e.g. brazed or welded) to the oblique planar edge 78 of the rear leg frame member 61 or 62.

Similarly, each of the downwardly and outwardly extending front portions 73 and 74 is shaped so that it can abut and be secured (e.g., brazed or welded) to the cylindrical outer surface of its respective front leg 91 or 92.

Figure 23:
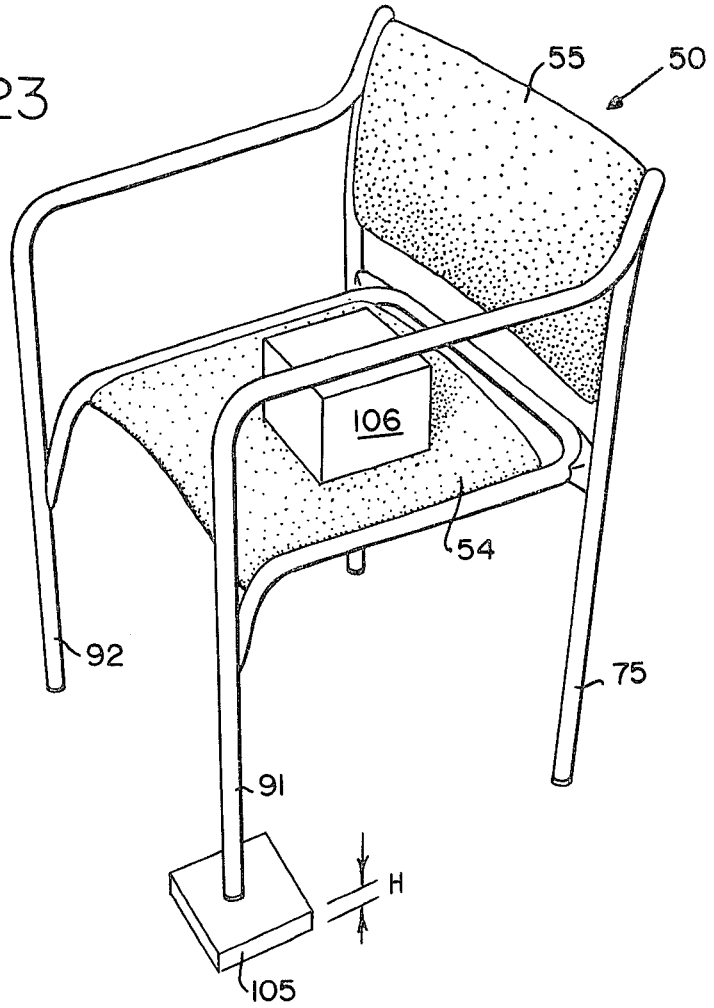
FIG. 23 is a view in perspective of a chair embodying the invention with one of the legs on a block, showing how the invention makes it possible to get even seating in spite of difference in height of the legs.
Figure 24:
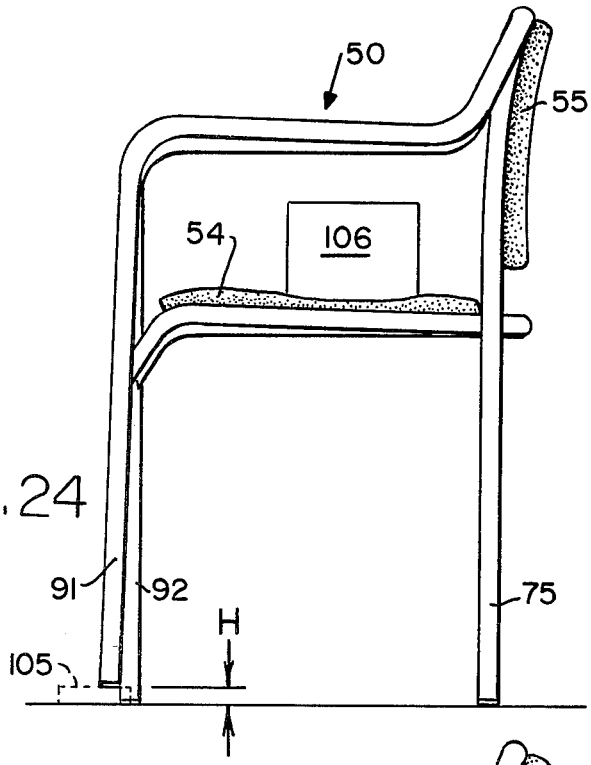
FIG. 24 is a view in side elevation of the chair with one of the front legs up on the block as in FIG. 23.
Figure 25:
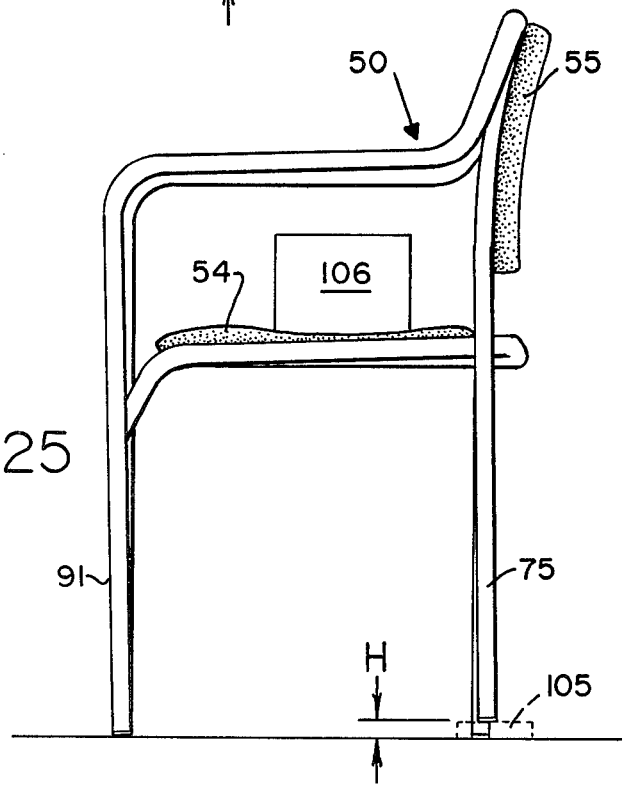
FIG. 25 is a similar view with a rear leg on the block.

Adaptation to an irregular surface (FIGS. 23–25)

The present invention enables the armchair 50 to adjust itself easily to an uneven surface. This is an important feature of the invention made possible by the way the frame 51 is assembled. Thus, as shown in FIGS. 23 and 24, for example, even if the left front leg 91 were placed up on a block 105 and a weight 106 is set on the seat 52. The block 105 corresponds to an uneven surface, as on an outdoor terrace or sidewalk, and the weight 106 corresponds to a sitter. As long as the weight on the chair 50 is at least about 25 kg., the chair will adjust itself so that it will not feel tippy or unstable even though the bottoms of the legs are at different levels. The height H of the block 105 shown in FIG. 24, which is made to scale, can be as much as one centimeter (ten millimeters). FIG. 25 shows that the same thing applies just as well for a rear leg 75 being the one where the rise in the ground surface is.

The stackability of the armchairs (FIGS. 3, 4 and 10–17)

Figure 3:
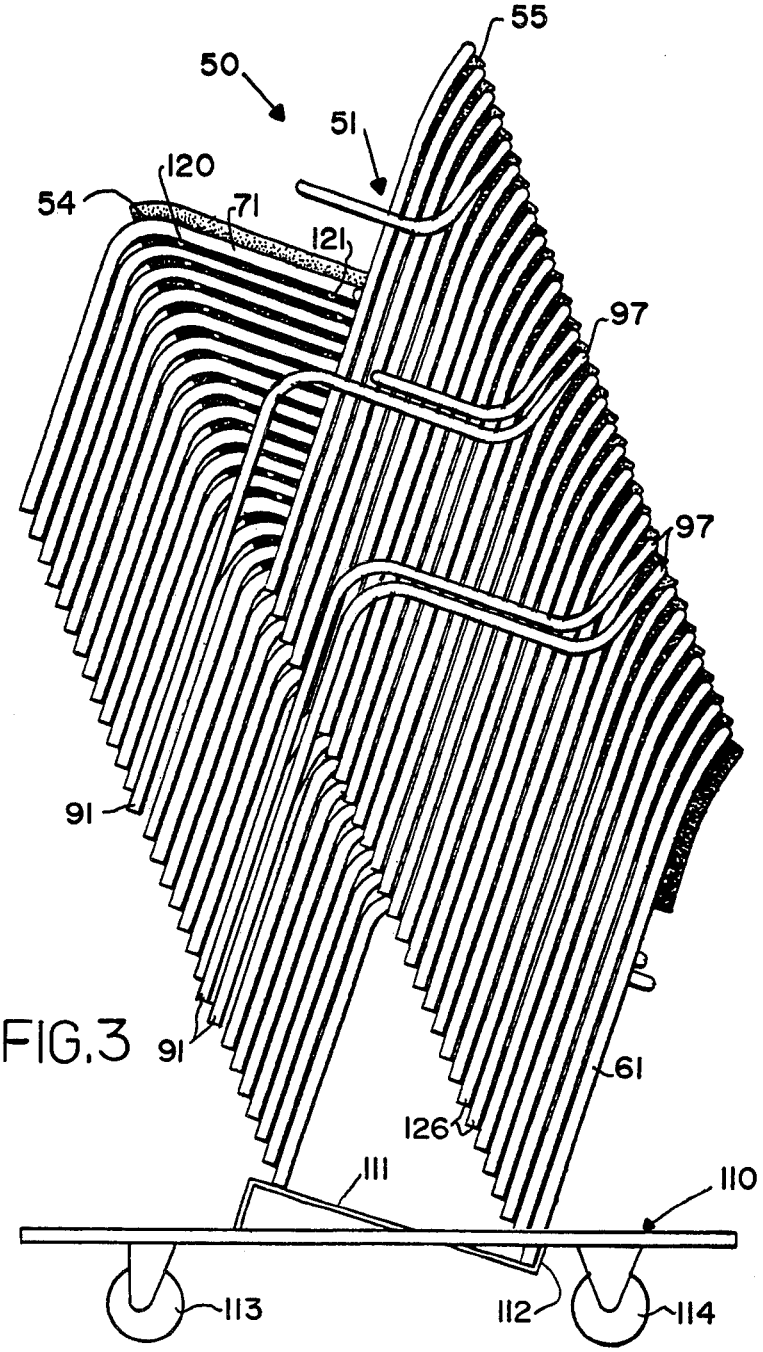
FIG. 3 is a view in side elevation of a compact stack of chairs, some like that of FIG. 1, others like those of U.S. Pat. No. 4,304,436, and still others like those of U.S. Pat. No. 4,366,980, all supported on a transporting dolly.

FIGS. 3 and 4 show that the armchairs 50 can be made very compactly stackable. The actual stack height per chair depends on the thickness of the frame members and on the spacing between them, which is kept quite close. Generally speaking, the seat 52 or 54 and back 53 or 55 are made thinner than the frame 51 and do not enter into consideration for compactness of stacking. As shown, the stacked armchairs in large groups are preferably supported on a dolly 110 having an inclined portion 111 and inclined back 112 for supporting both the front and rear legs of the bottom armchair and a portion of the rear leg frame members 61 and 62 leading up at the back. The subsequent stacking is then supported by the dolly 110 which, having wheels 113 and 114, can be moved from place to place.

As can be seen in FIG. 15, the rear leg frame members 61, 62 of upper chairs lie in between the side rail 71 or 72 and the arm 95 or 96 of the chairs below. Thus, they are stacked from above, preferably also from the front.

The relationships are shown in FIGS. 10–17. In FIG. 10, the backs of the chairs are not shown (and the frame members 61 and 62 are concealed by portions above them) so that the relation between the arms 95 and 96 and the side rails 71 and 72 and other parts are clear. This is further clarified by FIGS. 11 and 12, which illustrate the spacing achieved by the juncture members 63 and 64.

The relationship at the front of the chair 50 is shown in FIGS. 13–15 and 17, where it can be seen how the side rail 71 or 72 leads into the portion 73 or 74, which curves out and down to meet the front leg 91 or 92 to which it is brazed.

Figure 17:
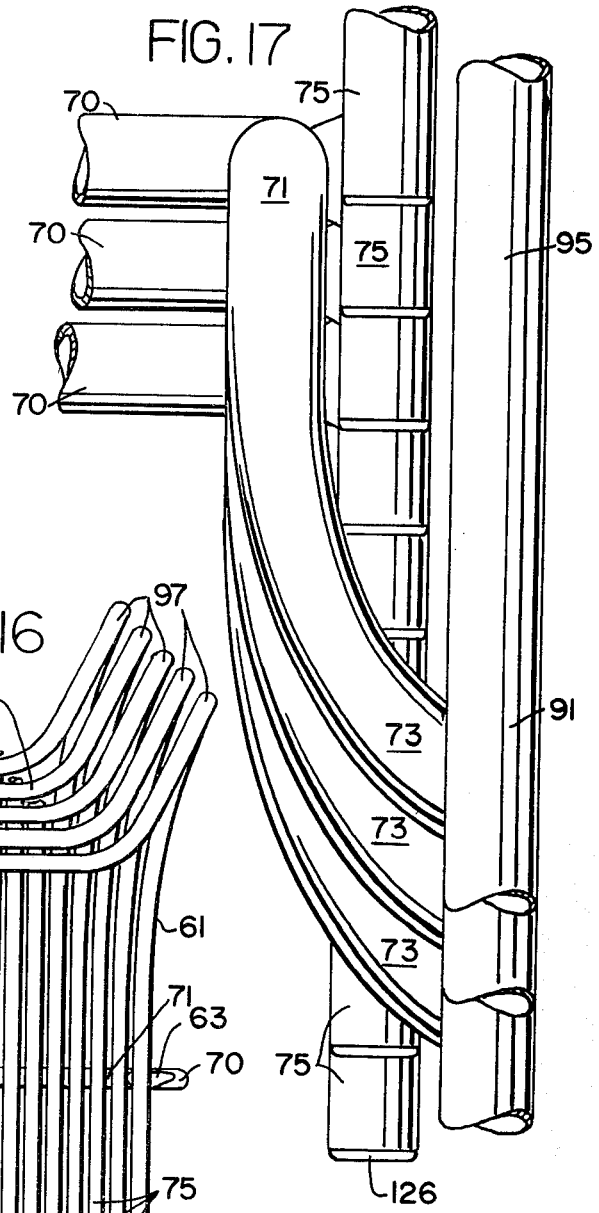
FIG. 17 is an enlarged fragmentary view taken along the line 17—17 in FIG. 16 showing again the rear legs climbing over the seat frame as that frame turns down to join the front leg.
Figure 16:
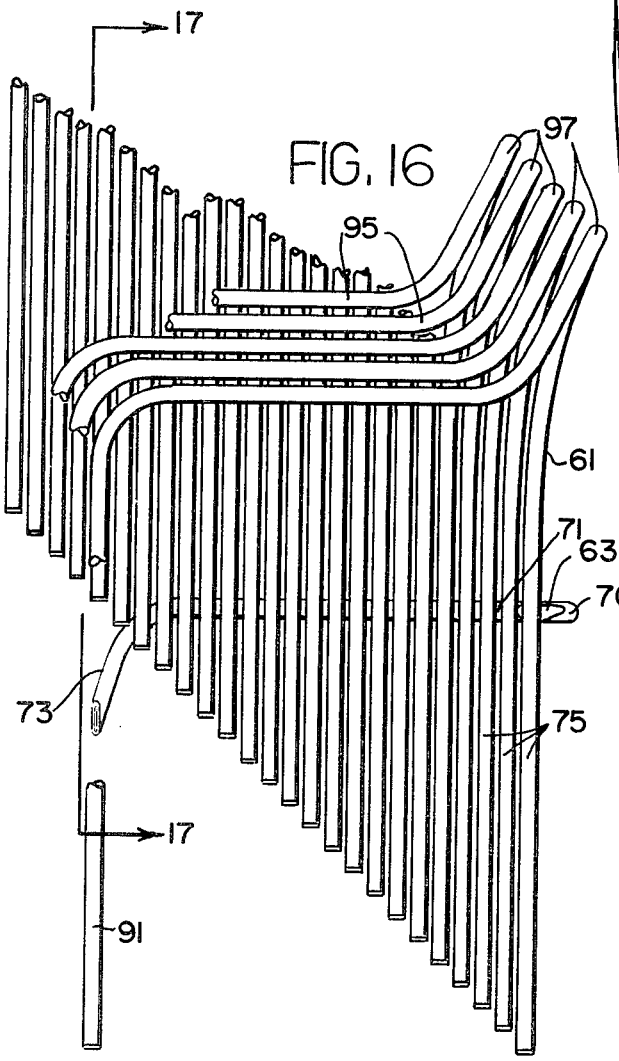
FIG. 16 is a fragmentary view in side elevation of a series of stacked chairs of the invention, with most of the arms and most of the side rails and U-shaped frame omitted in order to show how the rear legs eventually climb over the downwardly and outwardly turned portion of the seat side frame and over the forward ends of the arms and front leg.
Figure 18:
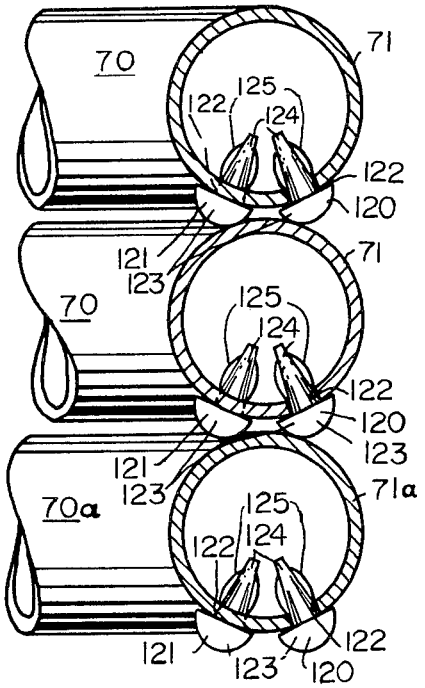
FIG. 18 is an enlarged view partly in vertical section through the front of the stacked frame side portions, looking rearwardly and showing the two spacer members which keep the frames from scratching each other during stacking and unstacking.

FIG. 15 shows how the rear leg frame members 61 and 62 climb upwardly in the stack. See especially their bottom glides 115, with each upper one above and forward of the lower ones. Similarly, the front legs 91 and 92 climb, with their bottom glides 116. FIG. 16 brings out how the chair 50 is proportioned so that when the rear leg members 61 and 62 arrive at the forward point where they might engage the front leg 91 and 92 then glides 115 are already above the point where they can engage the front leg 91 or 92 or the side rail segment 73. This is, of course, an important consideration. In the drawings there are twenty chairs in the stack by this point. There could be fewer (e.g. fifteen) or more (e.g. thirty) at this stage. FIG. 17 also shows this climbing from a different viewpoint, looking back toward the front of the chair.

Spacing during stacking (See FIGS. 3, 4, 15, 18 and 19)

Figure 19:
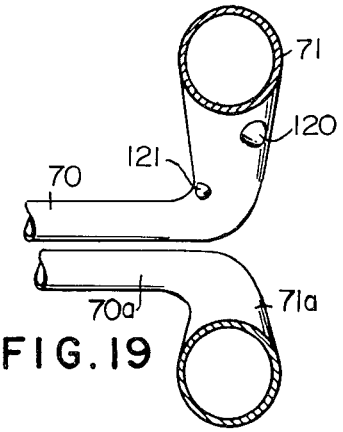
FIG. 19 is a view in vertical section taken through the side rails of two chairs, looking rearwardly, with the two about to be stacked, one being inclined down from the rear and the other upwardly from the rear.

The stacking, as shown in the drawings, calls for a buffering or spacing of the successive frames 51 from each other by a small amount in order to prevent the frames 51 from scratching each other during stacking and unstacking. For this purpose, a pair of plastic separators 120 and 121 are used on each side frame member 71, 72. The separators 120 and 121 are preferably identical, and they may be in the form of hole plugs secured to the main frame member 51. Preferably, they are located on the side members 71 and 72, one being located near the front thereof and the other near the rear, as shown in FIG. 19. In each instance, a hole 122 is drilled through the side member 71 and 72 to take each separating member 120, 121. The members 120 and 121 are preferably made of plastic, and each has a rounded head 123 and a generally conical stem 124 with a pair of flexible fins 125 that hold the stem 124 in place once it is inserted through the opening 122. Thus, the fins 125 tend to fold to permit entry of the stem 124 into the opening 122, but once through the opening 122, the fins 125 are difficult to retract. Only the heads 123 project from the openings 122, and they are held in place by the stem 124 and fins 125 so that they are held very close to the frame member, projecting only a sufficient amount to prevent the frames 51 from touching each other. These two plugs 120, 121 on each side are set so that one (either one) faces inwardly of the chair frame 51 and the other faces outwardly, providing a trough between them that helps to keep the stacked armchair frames 51 vertically aligned while at the same time providing the needed protection against abrasion. The distance between the point where the separator 120 bears against the chair frame member **71*a* below it and the actual top of that frame results in spacing between the two frame members 71 and 71*a***. Therefore, the stacking can be compact while direct frame contact is avoided, even at the arms.

Glides (FIGS. 1 and 2)

Suitable glides 126 may be used to support the armchair, and if the stock is tubular, then the glides 126 may each have a stem portion that is inserted up into each leg and fits snugly in the interior of the leg, while its exterior portion has substantially the same diameter as the armchair legs 75, 91, and 92. This helps to make a very trim-looking armchair.

Attachments for securing the Soflex® seats and backs (FIG. 2)

The armchair frame 51 as shown in FIG. 2 is preferably provided with a pair of seat-securing members 127 and a pair of back-securing members 128. These members 127 and 128 are clip-strips welded onto the side frames 71 and 72 for the seat 52 and to the back members 76 for the back 53 and have projections that enable a rapid and secure affixation of the seat 52 or 54 and the back 53 or 55. Loops on the ends of the seat 52 or 54 and back 53 or 55 engage the projections on the members 127 and 128, which then hold them in place. The projections may then be crimped around the end loops. The attachment of the seat and back urges the side members 71 and 72 and the back members 76 to a more nearly parallel position.

Use of a free-floating stretcher (FIGS. 20–22)

As shown in FIGS. 20 and 21, a free-floating stretcher rod 130 may be used to prevent any tendency of the armchair 50 to collapse with soft upholstery, or where the main frame 51 is aluminum. For this purpose, two openings 131 and 132 are drilled into the inside wall of the respective side members 71 and 72, and the rod 130, significantly smaller in diameter than either of these openings 131 and 132, is inserted to bridge the distance between the side members 71 and 72 and to extend into the frame to a position where it is capable of bearing against the opposite wall thereof. When the seat 52 or 54 is in place and no one is sitting on it, the rod 130 prevents any tendency for the armchair to be collapsed inwardly by abusive compressive forces; at the same time, since the connection is not rigid, it also perpetuates the frame's flexibility when the armchair is being sat upon and enables the desired vertical movement for a type of knee action that enables the armchair to adjust to uneven base surfaces, as described above, the different dimension H being shown in FIGS. 23, 24 & 25.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A frame for a stacking chair, including in combination:

a seat frame element having a U-shaped, horizontal portion having a rear, horizontal lateral stretcher portion joined at each end by a curved corner to a horizontal side portion, each said horizontal side portion being joined by a curved corner to a downwardly and outwardly extending frame portion having a truncated lower end, a pair of frame-juncture-and-spacing members each secured to said seat frame at opposite ends of said stretcher portion, a pair of rear leg frame members each having an upwardly extending back-support portion, each said rear leg frame member being secured to a said frame-juncture-and-spacing member and held thereby at a distance apart greater than the distance between the outermost portions of said side members, said back-support portion terminating at the upper end in an oblique edge surface, said back support portions being generally parallel to each other but diverging somewhat upwardly, and a pair of front leg and arm frame members each providing a vertical front leg and a coplanar horizontal arm spaced outwardly and above and parallel to said horizontal side portion of said seat frame member and having an upwardly and inwardly extending portion with an inboard rear surface secured to the oblique edge surface of said back-support portion, each said front portion of said seat frame element being secured to a said front leg.

2. The frame of claim 1 wherein each said frame juncture-and-spacing member has a generally horizontal portion with a pair of opposite generally horizontal edges and a generally vertical portion having a pair of generally vertical edges, each continuous with a said horizontal edge, one said horizontal edge and one vertical edge of each frame juncture member being secured to the side of said seat frame element adjacent to one of the corners at each end of said lateral portion and extending laterally beyond said side portions, and wherein the other said horizontal edge and the adjacent vertical edge are secured to a said rear leg frame member.

3. The frame of claim 2 wherein each said frame-juncture-and-spacing member has a generally horizontal top wall portion with a pair of opposite generally horizontal edges and a pair of opposite generally vertical wall portions extending down in between said horizontal edges, each vertical portion having a pair of generally vertical edges, each continuous with a said horizontal edge, one said horizontal edge and two adjacent said vertical edges of each frame juncture member being shaped to fit and secured to the side of said seat frame element adjacent to one of the corners at each end of said lateral portion and extending laterally beyond said side portions, the other said horizontal edge and the adjacent two vertical edges being shaped to and secured to a said rear leg frame member.

4. The frame of claim 3 wherein said seat frame element and said rear legs are tubular metal and said frame-juncture-and-spacing member is metal and has a short arcuate horizontal edge for welding to said rear leg and a wider horizontal edge for welding to said seat frame element, the generally horizontal top wall portion being substantially wider than the diameter of the tubular metal frame, said generally vertical walls being higher than the diameter of said tubular metal frame.

5. The frame of claim 4 wherein the welds are below said generally horizontal top wall portion and on the inside edges of said generally vertical side wall portions, so that the welds are generally hidden from view.

6. The chair frame of claim 1 wherein said seat frame element, said rear leg frame members, and said front leg and arm frame members are formed from the same tubular metal stock, the arm frame members being secured to said seat frame element and said rear leg frame members by brazing.

7. The chair frame of claim 6 wherein each said side portion is provided with two openings on its lower surface, the openings being spaced apart from front to rear and also spaced on opposite sides of the center of the lower surface, and two plastic members each secured in one said opening, so that one plastic member is near the front of said chair frame and one near the rear thereof, each plastic member having a portion projecting out from its said opening, one facing inwardly, and one facing outwardly of the chair, thereby providing spacing, vertical positioning, and scratch protection to said frame when a plurality of identical such chair frames are stacked on each other.

8. The chair frame of claim 6 having tubular legs and a bottom glide for each leg comprising a plastic member with a shank portion inserted inside the tubular leg and an enlarged outer portion of the same diameter as the leg.

9. The chair frame of claim 1 having secured to each said side portion and to each said back-support portion anchor means for securing said seat and said back to said frame.

10. The chair frame of claim 1 wherein there are horizontal openings near the front of said side portions, said openings facing each other and aligned with each other and a rigid member bridging said side portions and inserted loosely in both said openings, the rigid member being smaller in diameter than the openings.

11. A frame for a stacking chair, including in combination:

a tubular metal seat frame element having a U-shaped, horizontal portion with a pair of side rails joined by a rear, horizontal lateral stretcher portion joined at each end by a curve to a said side rail, each of said side rails being joined by a curve to a downwardly and outwardly extending front portion, a pair of one-piece metal frame-juncture-and-spacing members, each having a generally horizontal top wall with a pair of opposite generally horizontal edges and a pair of opposite generally vertical walls between said horizontal edges, each vertical wall having a pair of generally vertical edges, each continuous with a said horizontal edge, one said horizontal edge and two adjacent said vertical edges of each frame juncture member being shaped to conform to and welded to said seat frame element along a side rail and partially around one of the corners at each end of said stretcher portion and extending laterally beyond said side rails, a pair of separate tubular metal frame means for providing a pair of rear legs each having an upwardly extending back-support portion, each said rear leg being welded to the other said horizontal edge and to the adjacent vertical edge of a said frame-juncture-and-spacing member and held thereby at a distance apart greater than the distance between the outermost portions of said side members, said stretcher portion being the only lateral rigid member rigidly connected across the frame, said back-support portion terminating at the upper end in an oblique edge surface, said back support portions being generally parallel to each other but diverging somewhat upwardly, and a pair of arm and front leg members each having an inboard rear surface brazed to the oblique edge surface of said back-support portion and extending downwardly and forwardly therefrom and a generally horizontal forward arm portion continuous with said rear portion, said arms being substantially parallel with each other and with said side rails, but spaced outwardly from said side rails, said arms each curving into a vertical front leg continuous with said arm, each said front portion of said seat frame being brazed to a said front leg.

12. The chair frame of claim 11 wherein each said side rail is provided with two openings on its lower surface, the openings being spaced apart from front to rear and also spaced on opposite sides of the center of the lower surface, and two plastic members each secured in one said opening, so that one plastic member is near the front of said chair frame and one near the rear thereof, each plastic member having a portion projecting out from its said opening, one facing inwardly, and one facing outwardly of the chair, thereby providing spacing and scratch protection to said frame when a plurality of identical such chair frames are stacked on each other.

13. The chair frame of claim 11 having secured to each said side rail and to each said back-support portion anchor means for securing said seat and said back to said frame.

14. The chair frame of claim 11 wherein there are horizontal openings near the front of said side portions, said openings facing each other and aligned with each other and a rigid rod bridging said side portions and inserted loosely in both said openings, the rod being smaller in diameter than the openings.

15. A stacking chair, including in combination:

a seat frame element having a U-shaped, horizontal portion having a rear, horizontal lateral stretcher portion joined at each end by a curved corner to a horizontal side portion, each said horizontal side portion being joined by a curved corner to a downwardly and outwardly turned front portion, a pair of frame-juncture-and-spacing members, secured to said seat frame member near each end of said stretcher portion, frame means for providing a pair of rear legs each having an upwardly extending back-support portion, each said rear leg being secured to a said frame-juncture-and-spacing member and held thereby at a distance apart greater than the distance between the outermost portions of said side members, said back-support portions being generally parallel to each other and terminating at the upper end in an oblique edge surface, said back-support portions being generally parallel to each other but diverging somewhat upwardly, and a pair of arm and front leg frame members each having an inboard rear surface secured to the oblique edge surface of said back-support portion and extending downwardly and forwardly therefrom and a generally horizontal forward portion continuous with said rear portion, said arms being substantially parallel with each other and with said side rails, being above and outboard from said side rails and leading smoothly into vertical front legs at their forward ends, said front portions of said seat frame being each secured to an upper portion of a said front leg, a seat bridging and secured to said two side portions and urging them toward a truly parallel relationship, and a back, bridging and secured to said two back-support portions and urging them toward a truly parallel relationship.

16. The frame of claim 15 wherein each said frame-juncture-and-spacing member has a generally horizontal portion with a pair of opposite generally horizontal edges and a generally vertical portion having a pair of generally vertical edges, each continuous with a said horizontal edge, one said horizontal edge and one vertical edge of each frame juncture member being secured to the side of said main frame element adjacent to one of the corners at each end of said lateral portion and extending laterally beyond said side portions, and wherein the other said horizontal edge and the adjacent vertical edge are secured to a said frame means.

17. The chair of claim 16 wherein each said frame-juncture-and-spacing member has a generally horizontal top wall portion with a pair of opposite generally horizontal edges and a pair of opposite generally vertical wall portions extending down between said horizontal edges, each said vertical portion having a pair of generally vertical edges, each continuous with a said horizontal edge, one said horizontal edge and two adjacent said vertical edges of each frame juncture member being shaped to fit and secured to the side of said seat frame element adjacent to one of the corners at each end of said lateral portion and extending laterally beyond said side portions, the other said horizontal edge and the adjacent two vertical edges being shaped to and secured to a said rear leg.

18. The chair of claim 17 wherein said seat frame element and said rear legs are tubular metal and said juncture and spacing member is metal and has a short arcuate horizontal edge for welding to said rear leg and a wider horizontal edge for welding to said seat frame element, the generally horizontal top wall portion being substantially wider than the diameter of the tubular metal frame, said generally vertical walls being higher than the diameter of said tubular metal frame.

19. The chair of claim 18 wherein the welds are below said generally horizontal top wall portion and on the inside edges of said generally vertical side wall portions, so that the welds are generally hidden from view.

20. The chair of claim 18 wherein said seat frame element, said metal frame means, and said arm and leg frame members are formed from the same tubular metal stock, said arm and leg frame members being brazed to said seat frame element and said metal frame means.

21. The chair frame of claim 20 wherein each said side portion is provided with two openings on its lower surface, the openings being spaced apart from front to rear and also spaced on opposite sides of the center of the lower surface, and two plastic members each secured in one said opening, so that one plastic member is near the front of said chair frame and one near the rear thereof, each plastic member having a portion projecting out from its said opening, one facing inwardly, and one facing outwardly of the chair, thereby providing spacing, vertical positioning, and scratch protection to said frame when a plurality of identical such chair frames are stacked on each other.

22. The chair frame of claim 20 having tubular legs and a bottom glide for each leg comprising a plastic member with a shank portion inserted inside the tubular leg and an enlarged outer portion of the same diameter as the leg.

23. The chair frame of claim 15 having secured to each said side portion and to each said back-support portion anchor means securing said seat and said back to said frame.

24. The chair frame of claim 15 wherein there are horizontal openings near the front of said side portions, said openings facing each other and aligned with each other and a metal rod bridging said side portions and inserted loosely in both said openings, the rod being smaller in diameter than the openings.

25. The chair of claim 15 wherein the vertical thickness of said seat and the horizontal thickness of said back are thinner than the thicknesses of said seat frame element and of said frame means.

26. A stacking chair, including in combination:

a tubular metal seat frame element having a U-shaped, horizontal portion with a pair of side rails each joined by a curve to a rear, horizontal lateral stretcher portion, and each joined by a curve to a downwardly and outwardly extending short front portion, a pair of one-piece metal frame-juncture-and-spacing members, each having a generally horizontal top wall with a pair of opposite generally horizontal edges and a pair of opposite generally vertical walls between said horizontal edges, each vertical wall having a pair of generally vertical edges, each continuous with a said horizontal edge, one said horizontal edge and two adjacent said vertical edges of each frame juncture member being shaped to conform to and welded to said seat frame element along a side rail and partially around one of the corners at each end of said stretcher portion and extending laterally beyond said side rails, and tubular metal frame means for providing two completely separated rear legs each having an upwardly extending back-support portion, each said rear leg being welded to the other said horizontal edge and to the adjacent vertical edge of a said frame-juncture-and-spacing member and held thereby at a distance apart greater than the distance between the outermost portions of said side members, said stretcher portion being the only lateral rigid member rigidly connected across the frame, said back-support portions being generally parallel to each other but diverging somewhat upwardly, said back-support portion terminating at the upper end in an oblique edge surface, said back-support portions being generally parallel to each other but diverging somewhat upwardly, and a pair of arm and front leg frame members each having a rear surface brazed to the oblique edge surface of said back-support portion and extending downwardly and forwardly therefrom and a generally horizontal forward arm portion continuous with said rear portion, said arms being substantially parallel with each other and with said side rails, but outboard of said side rails, and a vertical front leg continuous with each said horizontal arm, said front portions of and seat frame being brazed to upper portions of respective said front legs, a non-rigid, resilient seat bridging and secured to said two side portions, and urging them toward a truly parallel relationship, and a non-rigid, resilient back, bridging and secured to said two back-support portions and urging them toward a truly parallel relationship.

27. The chair frame of claim 26 wherein the vertical thickness of said seat and said arms and the horizontal thickness of said back are thinner than the thickness of said frame element and said frame means, to enable compact stacking.

* * * * *